US005724080A

United States Patent [19]

Ikado

[11] Patent Number: 5,724,080

[45] Date of Patent: Mar. 3, 1998

[54] NON-STICKING PUMP FOR USE IN RECOVERY OF INK JET RECORDING APPARATUS

[75] Inventor: Masaharu Ikado, Suita, Japan

[73] Assignee: Canon Kabushiki Kaisha, Tokyo, Japan

[21] Appl. No.: 357,016

[22] Filed: Dec. 16, 1994

[30] Foreign Application Priority Data

| | | | |
|---|---|---|---|
| Dec. 20, 1993 | [JP] | Japan | 5-319987 |
| Dec. 20, 1993 | [JP] | Japan | 5-319991 |

[51] Int. Cl.[6] ..... B41J 2/175

[52] U.S. Cl. ..... 347/85

[58] Field of Search ..... 347/85, 30; 92/169.1

[56] References Cited

U.S. PATENT DOCUMENTS

| | | | |
|---|---|---|---|
| 3,892,166 | 7/1975 | Johansson | 92/169.1 |
| 4,053,901 | 10/1977 | Skafvenstedt et al. | 347/85 |
| 4,138,687 | 2/1979 | Cha et al. | 347/85 |
| 4,379,303 | 4/1983 | Nakagaki et al. | 347/85 |
| 5,357,275 | 10/1994 | Ikado et al. | 347/31 |
| 5,468,128 | 11/1995 | Benalikhodja | 347/85 |
| 5,485,187 | 1/1996 | Okamura et al. | 347/85 |

FOREIGN PATENT DOCUMENTS

| | | | |
|---|---|---|---|
| 61-258761 | 11/1986 | Japan | 347/85 |
| 2-194963 | 8/1990 | Japan | 347/85 |
| 4-369550 | 12/1992 | Japan | 347/85 |

OTHER PUBLICATIONS

JIS-B-0601, "Definitions and Designation of Surface Roughness," 1982, pp. 616–619.

*Primary Examiner*—Benjamin R. Fuller
*Assistant Examiner*—Judy Nguyen
*Attorney, Agent, or Firm*—Fitzpatrick, Cella, Harper & Scinto

[57] ABSTRACT

A pump is arranged to prevent adhesion between pump members caused by an increase in the viscosity of ink in the pump during a standby state of the pump. The pump has a cylinder, a piston which forms an internal space in the cylinder by being closely fitted in the cylinder and which causes a change in pressure in the internal space to expel ink through the ejection outlet of the ink jet head, and a seal member provided between a shaft of the piston and the cylinder so as to closely contact the shaft and the cylinder. The piston and the cylinder are released from a state of closely contacting each other when the piston is in a standby position. In another embodiment the shaft of the piston and the seal member are released from a state of closely contacting each other when the piston is in a standby position.

26 Claims, 8 Drawing Sheets

NON-STICKING PUMP FOR USE IN RECOVERY OF INK JET RECORDING APPARATUS

BACKGROUND OF THE INVENTION

1. Field of the Invention

This invention relates to an ink jet apparatus and a pump for use in the ink jet apparatus arranged so that the pump can maintain ink ejection through an ejection outlet in a good condition or expel ink through the ejection outlet in order to recover a good ejection condition.

2. Description of the Related Art

Conventionally, a plunger pump in a pump unit, for example, has been used as a pump for ink expelling means provided in a recovery system of an ink jet recording apparatus. In such a pump, a contact seal surface of a piston reciprocating in a cylinder is constantly maintained in close contact with the inner surface of the cylinder.

In the conventional ink jet recording apparatus having such a construction, there is a possibility that the viscosity of any ink attached to the contact seal surface of the piston will be increased during a long non-operating period. A pressure is constantly applied to the contact seal surface of the piston in order to maintain the contact seal surface in close contact with the cylinder. Accordingly, there is also a possibility that the piston may adhere strongly to the inner surface of the cylinder by ink having an increased viscosity. Therefore, when the pump is driven after being left in a non-operating state for a certain period of time, it is possible that the piston can be adhered so strongly to the cylinder that the pump cannot be operated by the ordinary driving energy generated by a drive source, resulting in failure to suitably operate the recovery system of the ink jet apparatus. In such a situation, operability can be restored only by a service call. Thus, the reliability of the apparatus is considerably reduced. To solve this problem, a method has generally been used in which the driving energy of a drive source is increased above the ordinarily required level so that the pump unit can be driven even in the above-described adhering state. That, however, entails wasteful use of energy when the pump is operating without adhesion of the piston to the cylinder, and a phenomenon that surplus energy results mainly in noise.

In particular, in the case of using a water resistant ink, the above-described problem arises more readily because the percentage of volatile components in such ink is comparatively large.

SUMMARY OF THE INVENTION

An object of the present invention is to provide a pump free from the problem of the above-described adhesion or the like and having improved reliability, and an ink jet apparatus using the pump.

Another object of the present invention is to provide an ink jet apparatus and a pump for use in the ink jet apparatus arranged so that a driving force of a drive source for driving the pump is not excessively large, that is, energy is not wastefully consumed to drive the pump, and substantially no noise is caused by the driving.

To achieve these objects, according to the present invention, there is provided an ink jet apparatus comprising a pump for ejecting ink through an ejection outlet of an ink jet head, the pump having a cylinder, a piston which forms an internal space in the cylinder by being closely fitted in the cylinder and which causes a change in pressure in the internal space to expel ink through the ejection outlet of the ink jet head, and a seal member provided between a shaft of the piston and the cylinder so as to closely contact the shaft and the cylinder, the apparatus also comprising a member for mounting the ink jet head, wherein the shaft of the piston and the seal member are released from a state of closely contacting each other when the piston is set in a standby position.

According to another aspect of the invention, there is provided a pump used in an ink jet apparatus to eject ink through an ejection outlet of an ink jet head, the pump comprising a cylinder, a piston which forms an internal space in the cylinder by being closely fitted in the cylinder and which causes a change in pressure in the internal space to expel ink through the ejection outlet of the ink jet head, and a seal member provided between a shaft of the piston and the cylinder so as to closely contact the shaft and the cylinder, wherein the shaft of the piston and the seal member are released from a state of closely contacting each other when the piston is set in a standby position.

In these arrangements of the present invention, adhesion between the cylinder, the piston and/or the seal member can be avoided by providing a certain amount of play between these members to prevent occurrence of pump adhesion substantially completely. Even if some portions do adhere to each other, they can be easily released driving the pump with the ordinary driving force of a pump drive source.

According to the present invention, the cylinder and the piston are released from the close-contact state when the piston of the pump is set in the standby position. Therefore, there is substantially no possibility of the cylinder and the piston adhering to each other by ink even when the pump is left in a non-operating state for a long period of time.

Further, according to the present invention, the shaft of the piston and the seal member are released from the close-contact state when the piston of the pump is set in the standby position. Therefore, there is substantially no possibility of the plunger and the seal member adhering to each other by ink even when the pump is left in a non-operating state for a long period of time. Thus, according to the present invention, an ink jet apparatus and a pump for use in an ink jet apparatus having improved reliability can be obtained.

DESCRIPTION OF THE PREFERRED EMBODIMENTS

The preferred embodiments of the present invention will be described below with reference to the accompanying drawings.

Figure 2:
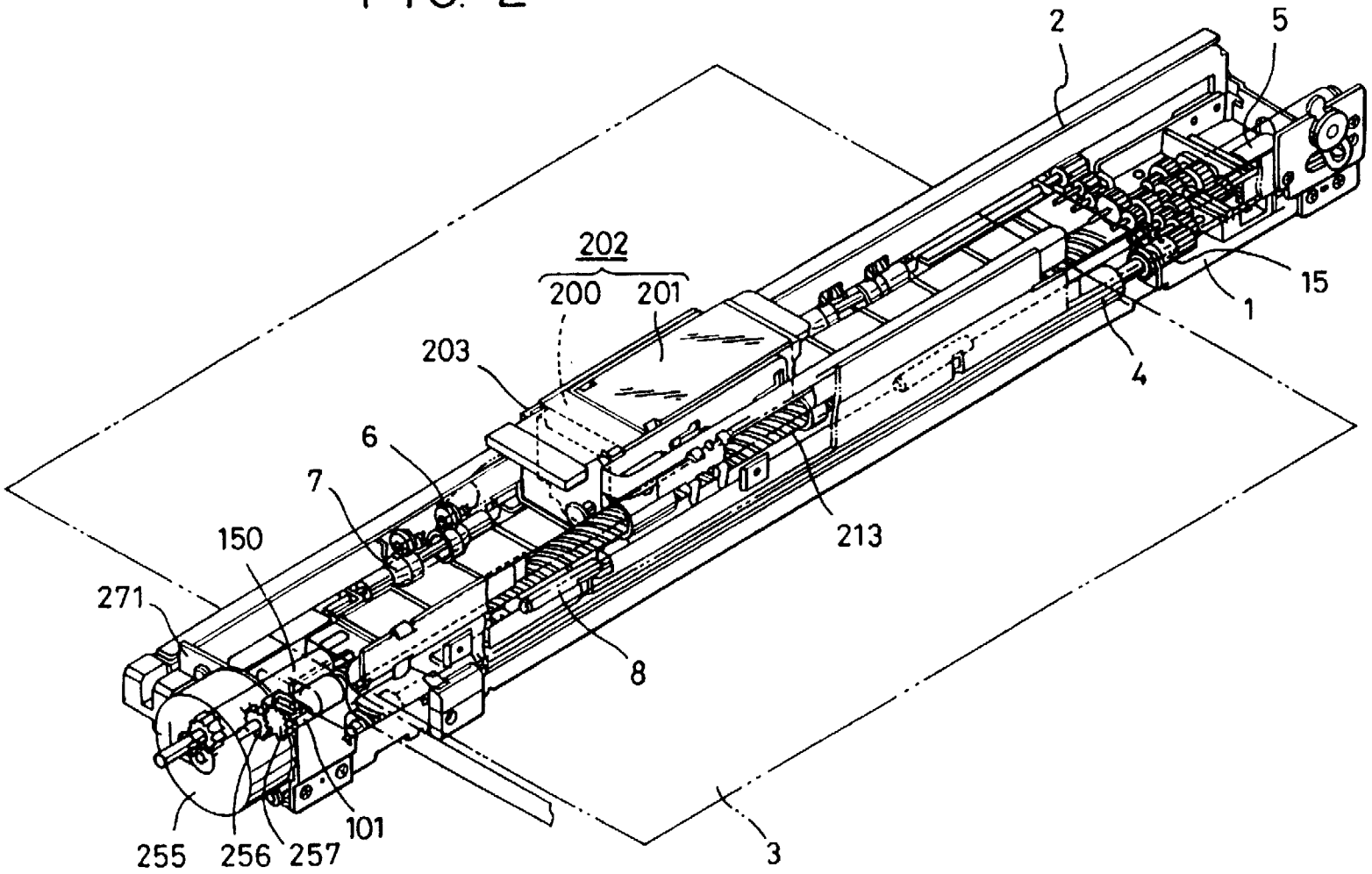
FIG. 2 is a perspective view of an essential portion of an ink jet apparatus in accordance with the present invention.

FIG. 2 is a perspective view showing an essential portion of an ink jet apparatus in accordance with the present invention. A head cartridge 202 in which an ink jet head (recording head) 200 constituting a recording means and an ink tank 201 are connected is mounted on a carrier 203 shown in FIG. 2. One end of the carrier 203 on the recording head 200 side is fitted to a lead screw 213 so as to be slidable along the axial direction of the lead screw 213. The lead screw 213 is rotatably mounted on a chassis 1. A guide is provided on the other end of the carrier 203 and is fitted to a guide rail 2 formed in the chassis 1 so as to be slidable parallel to the axial direction of the lead screw 213. The carrier 203 is reciprocatingly movable along the axial direction of the lead screw 213 with the rotation of the lead screw 213 while its attitude is maintained always constant.

Figure 3:
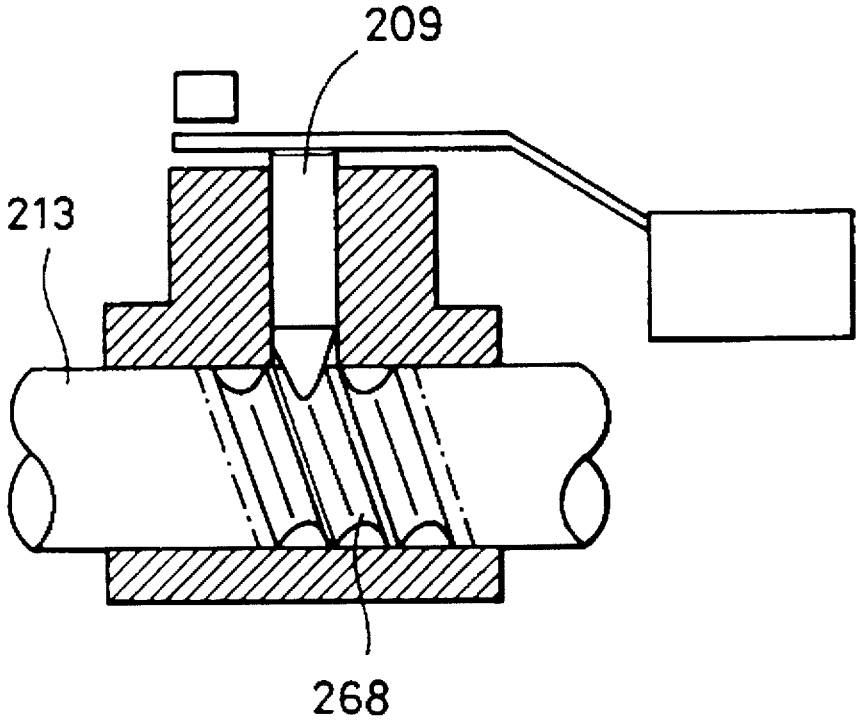
FIG. 3 is an enlarged sectional view of a carrier bearing portion in accordance with the present invention.

As illustrated in FIG. 2, a lead screw gear 257 fixed to the left end of the lead screw 213 and a pinion gear 256 fixed to a carrier motor 255 mesh with each other. As illustrated in FIG. 3 showing a carrier bearing portion, a lead pin 209 attached to the carrier 203 is fitted in a guide groove 268 which is helically (spirally) formed in the lead screw 213 with a predetermined pitch. Accordingly, when the lead screw 213 rotates with the rotation of the carrier motor 255 in normal and reverse directions, the carrier 203 is reciprocated.

This ink jet apparatus records characters or the like in one line on a recording member 3 by ejecting ink in accordance with a recording signal and by driving the recording head 200 in synchronization with the above-described reciprocating travel of the carrier 203. The recording head 200 has fine ink outlets, ink passages communicating with the ink outlets, and energy generation means for generating energy used to eject ink through each outlet. The energy generation means is, for example, an electromechanical transducer such as a piezoelectric element, a means for applying electromagnetic waves such as laser light to the ink to heat it, or an electrothermal transducer such as a heating element capable of generating thermal energy. A recording head having a thermal energy generation means as such energy generation means is capable of high-resolution recording, because ejection outlets can be arranged at a high density. Among recording heads having such means, a recording head having an electrothermal transducer is particularly advantageous because it can be easily reduced in size, can be designed by utilizing the advantages of the IC technology and microprocessing technology that have recently advanced remarkably in terms of techniques and reliability, can be easily designed for high-density packaging and can be manufactured at a low cost.

When recording of one line is completed by scanning the carrier 203, the recording member 3 is transported by a transport means to an extent corresponding to the area for recording one line. The recording member 3 is transported by a transport roller 4, a pinch roller 8 mated with and pressed against the transport roller 4, discharge rollers 7 and spurs 6 contacting the discharge rollers 7. More specifically, the recording member 3 having a recording surface facing the ejection outlet surface of the recording head 200 is pressed against the transport roller 4 by the pinch roller 8, and the transport roller 4 is suitably rotated by a feed motor 5 to transport the recording member 3 to a necessary extent to a recording position. After recording, the recording member 3 is pressed against the discharge rollers 7 by the spurs 6 and is discharged out of the apparatus by the rotation of the discharge rollers 7. The transport roller 4 and the discharge rollers 7 are driven by the feed motor 5, and the driving force of the feed motor 5 is transmitted by a reduction gear train 15.

Figure 4:
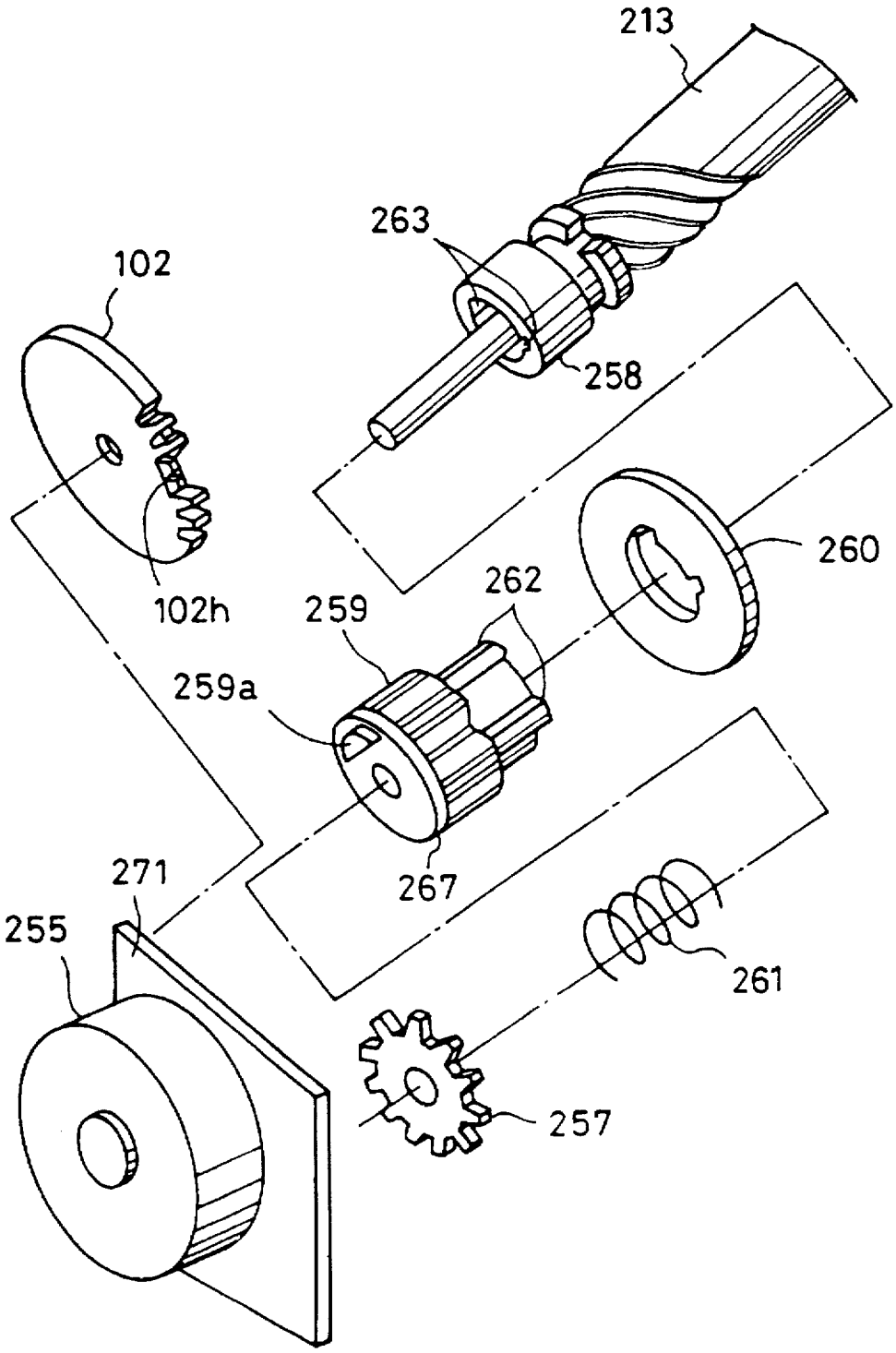
FIG. 4 is an exploded perspective view of a left end portion of a lead screw including a clutch mechanism in accordance with the present invention.

FIG. 4 is an exploded perspective view of a left end portion of the lead screw 213, including a clutch mechanism for transmitting the driving force of the carrier motor 255 to a recovery system through the lead screw 213. An initial lock 258, a clutch plate 260, a clutch gear 259, and a return spring 261 are provided at the left end of the lead screw 213.

The initial lock 258 is fixed to the lead screw 213. The clutch gear 259 is fitted to the lead screw 213 and is axially slidable thereon, and a part of the clutch gear 259 is inserted into the interior of the initial lock 258. That is, projections 262 are formed in two places in asymmetrical positions on a circumferential portion of the clutch gear, and the projections 263 are fitted in recesses 263 formed in the initial lock 258 in phase with the projections 262 so as to be movable only in the axial direction.

A flange 267 forms an end surface of the clutch gear 259 on the lead screw gear 257 side, and a trigger tooth **259*a* is formed on the flange 267 for giving a rotational trigger to a control gear 102. The control gear 102 has teeth in its outer circumferential portion and is positioned so that the teeth mesh with the clutch gear 259 on the lead screw 213 when the lead screw 213 is fitted in a recovery system plate 271. However, during a recording operation, a cutout portion of the outer circumference of the control gear 102 faces the clutch gear 259, and the control gear 102 does not mesh with the clutch gear 259. Several teeth of a side gear 102*h* are formed on a side surface of the cutout portion of the control gear 102. The side gear 102*h* meshes with the trigger tooth 259*a* of the clutch gear 259 to give a rotational trigger to the control gear 102**.

Figure 5:
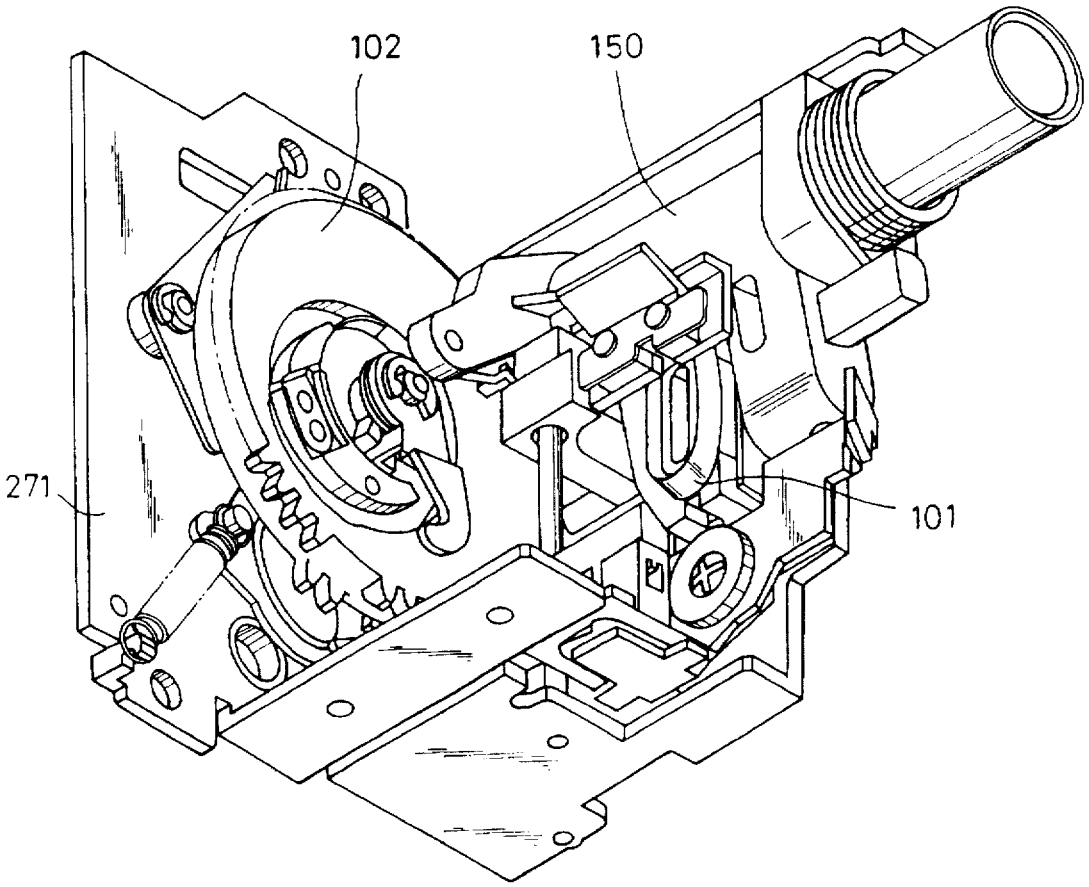
FIG. 5 is a perspective view of a recovery unit in accordance with the present invention.

FIG. 5 is a perspective view of a recovery system unit in accordance with the present invention. As shown in FIG. 5, there are arranged a cap 101 for capping the ejection outlet surface of the recording head 200, a pump unit 150 for drawing ink from the ejection outlets through the ink cap 101 by creating an internal negative pressure and for discharging the drawn ink to an ink absorber, and the control gear 102 and other members of a transmission mechanism section consisting of a cam and a gear mechanism for moving the cap 101 toward or away from the outlet surface, for transmitting a driving force to the pumping unit 150 and for operating a wiping mechanism for wiping ink off the outlet surface. A rotational driving force of the carrier motor 255 is transmitted to the control gear 102 through the above-mentioned clutch gear 259.

Figure 1B:
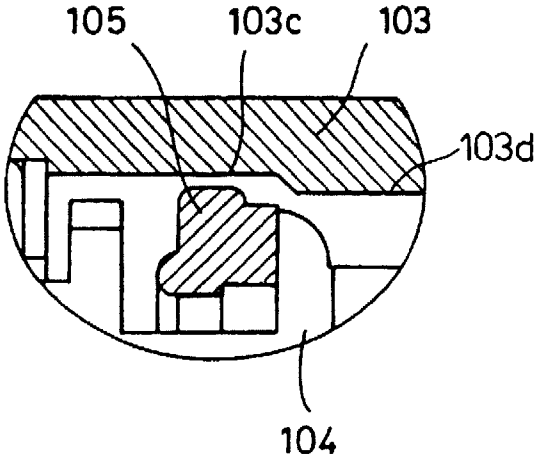
FIG. 1B is a detailed view of portion 1B in FIG. 1A.
Figure 1A:
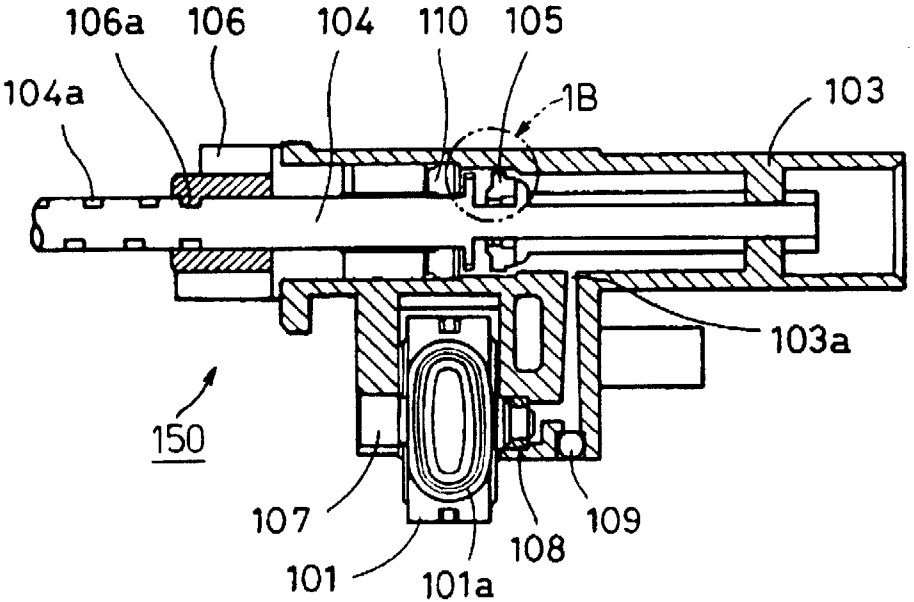
FIG. 1A is a cross-sectional view of a pump unit in accordance with a first embodiment of the present invention.

FIG. 1A is a cross-sectional view of an example of the pump unit 150 in accordance with the first embodiment of the present invention. The pump unit 150 of this embodiment has a plunger pump construction such as that illustrated in FIG. 1A. The pump of this embodiment has a cylinder 103, a piston which forms an internal space in the cylinder 103 by being closely fitted in the cylinder 103 and which causes a change in the pressure in the internal space to expel ink through the ejection outlets of the recording head, and a pump seal 110 which is provided between a shaft portion of the piston and the cylinder so as to tightly contact these members. The piston assembly of this embodiment has a shaft 104 and an elastic member 105 loosely fitted around the shaft 104. For convenience's sake, the shaft 104 will hereinafter be referred to as the "plunger", and the elastic member 105 as the "piston". The cylinder 103 and the plunger 104 are each formed of polyoxymethylene (POM), while the piston 105 and the pump seal 110 are each formed of silicone rubber.

While the cap 101 is capping the ejection outlets of the recording head 200, the piston 105 attached to the plunger 104 is reciprocated to cause an internal negative pressure. Ink is thereby drawn from the recording head 200 through the cap 101 and an ink drawing port 103*a*, whereby the ejection function is recovered or a good ejection condition is maintained. The reciprocating movement of the piston 105 is caused by rotating a stroke gear 106 having a projection 106*a* which is fitted in a lead groove 104*a* formed in the plunger 104. Further, the stroke gear 106 is rotated by meshing with the above-mentioned control gear 102. In consequence, rotational driving force is transmitted to the stroke gear 106 from the carrier motor 255. The cap 101 can be moved closer to or away from the recording head 200 by the above-mentioned cam of the control gear 102. Ordinarily, the cap 101 is formed of an elastic material having a low gas permeability and excellent ink resistance. In this embodiment, the cap is formed of a hydrogenated butyl rubber. The pump seal 110 is an elastic seal member which closely contacts both the inner circumferential surface of the cylinder 103 and the outer circumferential surface of the plunger 104, and which is provided to realize a closed space in the pump. A cap lever 107 is a member which intermediates between the cap 101 and the interior of the cylinder 103, and an ink passage is formed through the cap lever 107. The ink passage is sealed by a cap lever seal 108 and a stainless steel (SUS) ball 109 at intermediate positions to maintain airtightness between the ink drawing port 103*a* of the cylinder and a surface 101*a* of the cap 101 which can be maintained in close contact with the recording head.

In this embodiment, as illustrated in the enlarged FIG. 1B, a standby portion 103*c* of the inner circumferential surface of the cylinder 103 has a larger diameter relative to another portion (that is, an operating portion 103*d*) so that the outer circumferential surface of the piston 105 and the inner circumferential surface of the cylinder 103 do not contact or loosely fit each other when the piston 105 is maintained in a standby state at top dead center. The diameter of the standby portion 103*c* in the inner circumferential surface of the cylinder 103 is set to 5.3 mm and the diameter of the operating portion 103*d* operating portion of the cylinder is set to 4.9 mm. Consequently, there is substantially no possibility of contact between the piston 105 and the cylinder 103 when the pump is maintained in the standby state and, hence, no possibility of the piston 105 and the cylinder 103 adhering to each other by virtue of increased-viscosity ink.

Figure 6:
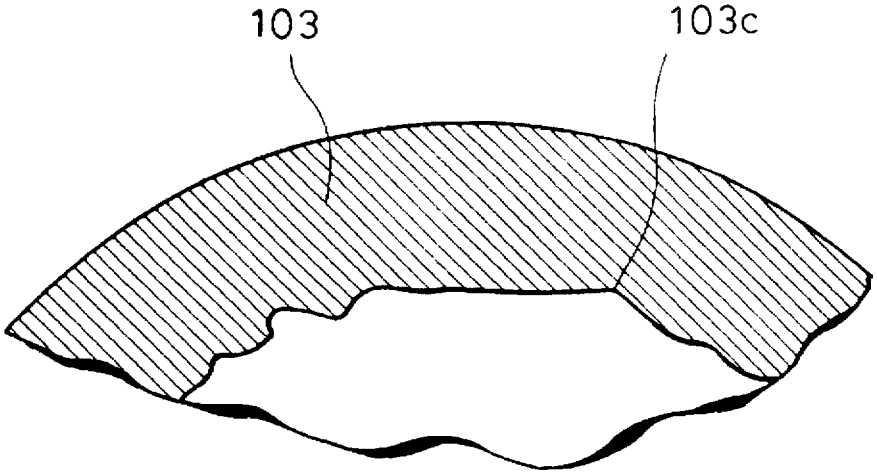
FIG. 6 is an enlarged sectional view of a portion of a cylinder in accordance with a second embodiment of the present invention.

FIG. 6 is an enlarged sectional view of a portion of a cylinder of a pump unit in accordance with a second embodiment of the present invention. In this embodiment, the roughness of the standby portion 103*c* (which has a larger diameter than the operating portion 103*d*) of the inner circumferential surface of the cylinder 103 is increased greater than that of the operating portion 103*d*. The roughness of the larger-diameter portion 103*c* of the inner circumferential surface of the cylinder 103 is set to 100 S while the roughness of the operating portion is set to 0.8 S. As a result, ink exists mainly in dips and irregularities of the portion 103*c*, and the amount of ink at peaks of the irregularities which may contact the piston 105 is small. The effect of preventing adhesion of the piston 105 is thereby further improved.

Figure 7:
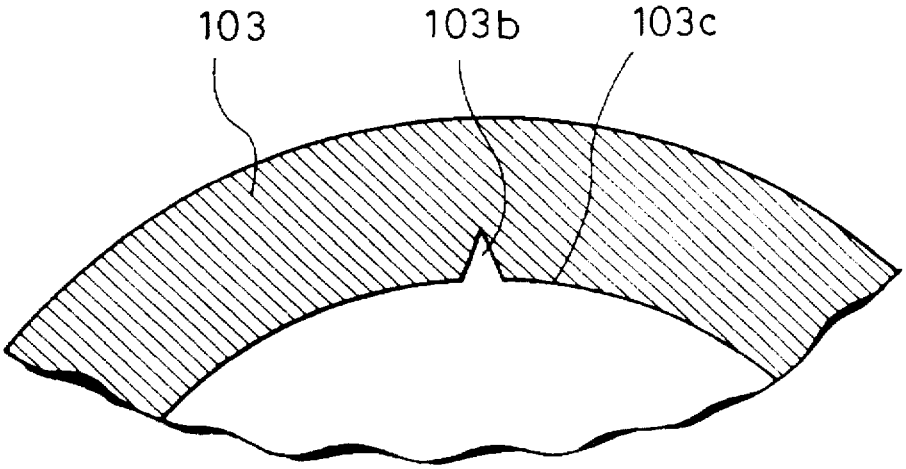
FIG. 7 is an enlarged sectional view of a portion of a cylinder in accordance with a third embodiment of the present invention.

FIG. 7 is an enlarged sectional view of a portion of a cylinder of a pump unit in accordance with a third embodiment of the present invention. In this embodiment, a recess, e.g., a groove 103*b*, is formed in the larger-diameter portion 103*c* of the inner circumferential surface of the cylinder 103. The maximum depth of the groove 103*b* is set to 0.3 to 0.5 mm. In this pump, ink on the cylinder inner surface is drawn into the groove by capillary attraction so that there is substantially no possibility of the cylinder and the piston contacting each other through ink, thus further improving the adhesion prevention effect.

The larger-diameter portion of the inner circumferential surface of the cylinder 103 in accordance with each of the above-described embodiments is processed to have an ink repelling property. As a result, ink will not readily remain on the processed portion and the adhesion prevention effect was further improved. A fluororesin "CYTOP" (a product from Asahi Glass Co., Ltd.) produced as a water repellent material is an example of a suitable ink repellent.

Also, in a fourth embodiment of the invention the diameter of a portion of the shaft 104 of the piston facing the seal member 110 when the piston 105 is at the standby position is reduced to avoid adhesion between the shaft 104 of the piston and the seal member 110. The shaft 104 and the seal member 110 are thereby prevented from adhering to each other and a further preferable effect can be achieved.

Figure 8B:
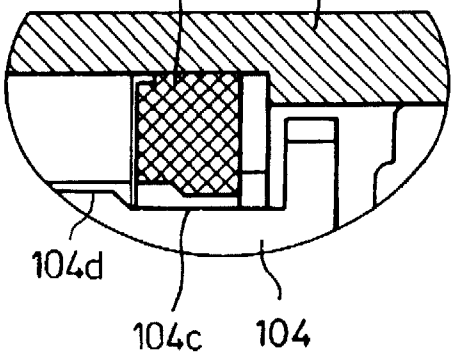
FIG. 8B is a detailed view of portion 8B in FIG. 8A.
Figure 8A:
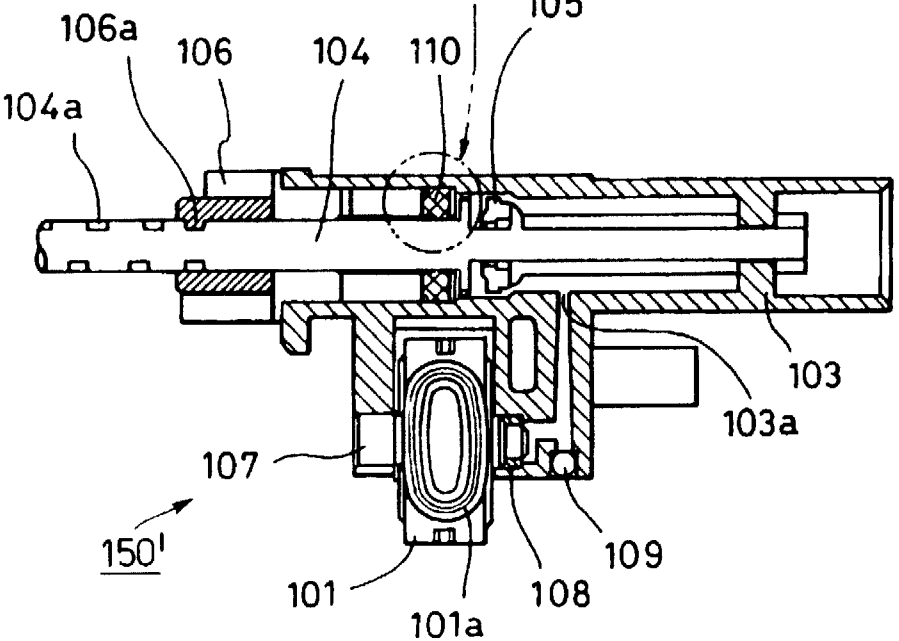
FIG. 8A is a cross-sectional view of a pump unit in accordance with a fourth embodiment of the present invention.

FIG. 8A is a cross-sectional view of a pump unit in accordance with the fourth embodiment of the present invention. The pump unit 150' of this embodiment has a plunger pump construction such as that illustrated in FIG. 8A. The pump of this embodiment has a cylinder 103, a piston which forms an internal space in the cylinder 103 by being closely fitted in the cylinder 103 and which causes a change in the pressure in the internal space to expel ink through the ejection outlets of the recording head, and a pump seal 110 which is provided between a shaft portion of the piston and the cylinder so as to tightly contact these members. As before, the piston assembly of this embodiment has a shaft 104 and an elastic member 105 loosely fitted around the shaft 104. For convenience's sake, the shaft 104 will hereinafter be referred to as "plunger", and the elastic member 105 as "piston". The cylinder 103 and the plunger 104 are each formed of polyoxymethylene (POM), while the piston 105 and the pump seal 110 are each formed of silicone rubber.

While the cap 101 is capping the ejection outlets of the recording head 200, the piston 105 attached to the plunger 104 is reciprocated to cause an internal negative pressure. Ink is thereby drawn from the recording head 200 through the cap 101 and an ink drawing port 103*a*, whereby the ejection function is recovered or a good ejection condition is maintained. The reciprocating movement of the piston 105 is caused by rotating a stroke gear 106 having a projection 106*a* which is fitted in a lead groove 104*a* formed in the plunger 104. Further, the stroke gear 106 is rotated by meshing with the above-mentioned control gear 102. In consequence, rotational driving force is transmitted to the stroke gear 106 from the carrier motor 255.

The cap 101 can be moved closer to or away from the recording head 200 by the above-mentioned cam of the control gear 102. Ordinarily, the cap 101 is formed of an elastic material having a low gas permeability and excellent ink resistance. In this embodiment, the cap is formed of a hydrogenated butyl rubber. The pump seal 110 is an elastic seal member which closely contacts both the inner circumferential surface of the cylinder 103 and the outer circumferential surface of the plunger 104, and which is provided to realize a closed space in the pump during operation thereof. A cap lever 107 is a member which intermediates between the cap 101 and the interior of the cylinder 103, and an ink passage is formed through the cap lever 107. The ink passage is sealed by a cap lever seal 108 and a stainless steel (SUS) ball 109 at intermediate positions to maintain airtightness between the ink drawing port 103*a* of the cylinder and a surface 101*a* of the cap 101 which can be maintained in close contact with the recording head.

In this embodiment, as illustrated in the enlarged FIG. 8B, a portion 104*c* of the outer circumferential surface of the plunger 104 has a smaller diameter relative to another portion 104*a* of the plunger so that the outer circumferential surface of the plunger 104 and the inner circumferential surface of the seal member 110 do not contact each other when the piston 105 is maintained in a standby state at top dead center. The diameter of the portion 104*c* in the outer circumferential surface of the plunger 104 is set to 2.4 mm and the diameter of the other portion is set to 2.8 mm. Consequently, there is substantially no possibility of contact between the plunger 104 and the seal member 110 when the pump is maintained in the standby state and, hence, no possibility of the plunger 104 and the seal member 110 adhering to each other by virtue of increased-viscosity ink.

Figure 9:
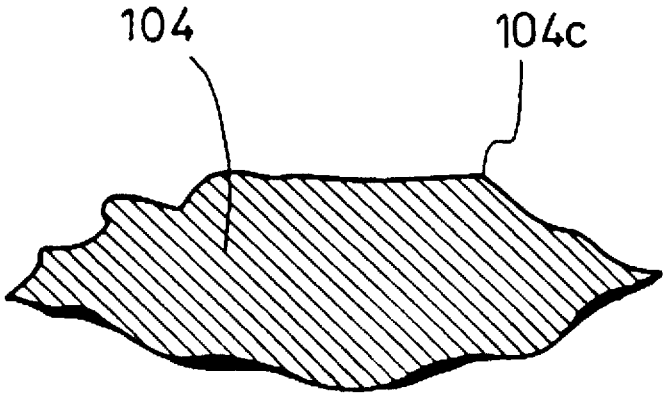
FIG. 9 is an enlarged sectional view of a portion of a plunger in accordance with a fifth embodiment of the present invention.

FIG. 9 is an enlarged sectional view of a portion of a cylinder of a pump unit in accordance with a fifth embodiment of the present invention. In this embodiment, the roughness of the smaller-diameter portion 104*c* of the inner circumferential surface of the plunger 104 is greater than that of the other portion. The roughness of the smaller-diameter portion 104*c* of the inner circumferential surface of the plunger 104 is set to 100 S while the roughness of the other portion is set to 0.8 S. As a result, ink exists mainly in dips and irregularities of the portion 104*c*, and the amount of ink at peaks of the irregularities which may contact the seal member 110 is small. The effect of preventing adhesion of the plunger 104 is thereby further improved.

Figure 10:
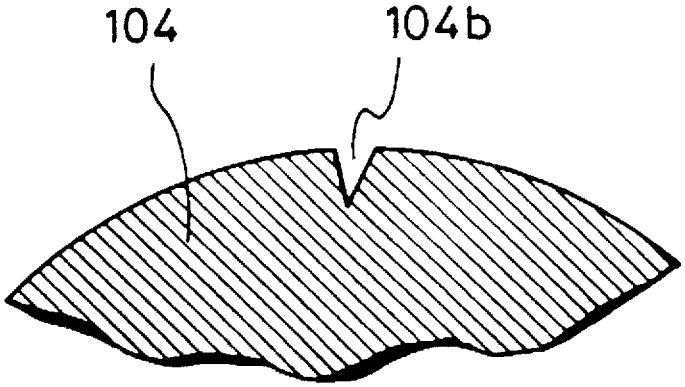
FIG. 10 is an enlarged sectional view of a portion of a plunger in accordance with a sixth embodiment of the present invention.

FIG. 10 is an enlarged sectional view of a portion of a cylinder of pump unit in accordance with a sixth embodiment of the present invention. In this embodiment, a recess, e.g., a groove 104*b*, is formed in the smaller-diameter portion 104*c* of the inner circumferential surface of the plunger. The maximum depth of the groove 104*b* is set to 0.3 to 0.5 mm. In this pump, ink on the plunger outer surface is drawn into the groove by capillary attraction so that there is substantially no possibility of the plunger and the seal member contacting each other through the ink, thus further improving the adhesion prevention effect.

The smaller-diameter portion of the inner circumferential surface of the plunger 104 in accordance with each of the above-described embodiments was processed to have an ink repelling property. As a result, ink will not readily remain on the processed portion and the adhesion prevention effect was further improved. A fluororesin "CYTOP" (a product from Asahi Glass Co., Ltd.) produced as a water repellent material is an example of a suitable ink repellent.

Each of the above-described pumps can applied to an ink jet apparatus using a water resistant ink containing a pigment. As a result, an improved ink jet apparatus and a pump free from pump that is adhesion and has improved reliability can be obtained.

While the present invention has been described with respect to what is presently considered to be the preferred embodiments, it is to be understood that the invention is not limited to the disclosed embodiments. The present invention is intended to cover the various modifications and equivalent arrangements included within the spirit and scope of the appended claims.

What is claimed is:

1. An ink jet apparatus having a recording head for ejecting ink onto a recording medium, said apparatus comprising:

a pump, including a cylinder having an operating portion having an inner wall of a first inner diameter and a standby portion having an inner wall of a second inner diameter, and a piston having an outer diameter and an outer circumferential surface that is adapted to be in direct engagement with said inner wall of said operating portion, said piston being disposed within said cylinder and mounted for relative movement with said cylinder between said operating portion, wherein the outer diameter of said piston closely fits the first inner diameter of said cylinder, and said standby portion, wherein the entire outer circumferential surface of said piston loosely fits the second inner diameter of said cylinder, and a port in said cylinder for communicating with said recording head; and drive means for moving said piston relative to said cylinder to generate pressure at said port while said piston occupies said operating portion.

2. An ink jet recording apparatus according to claim 1, wherein the second inner diameter of said inner wall of said cylinder corresponding to said standby portion is larger than the first inner diameter of said inner wall of said cylinder corresponding to said operating portion.

3. An ink jet apparatus according to claim 2, wherein a surface roughness of said inner wall of said cylinder corresponding to said standby portion is larger than a surface roughness of said inner wall of said cylinder corresponding to said operating portion.

4. An ink jet apparatus according to claim 2, wherein a recess is formed in said inner wall of said cylinder corresponding to said standby portion.

5. An ink jet apparatus according to any one of claims 1, 2, 3 and 4, wherein said inner wall of said cylinder corresponding to said standby portion has an ink repellent property.

6. An ink jet apparatus according to any one of claims 1, 2, 3 and 4, wherein said recording head has an ejection outlet and energy generation means for generating energy utilized to eject ink through said ejection outlet.

7. An ink jet apparatus according to claim 6, wherein said energy generation means comprises an electrothermal transducer capable of generating thermal energy.

8. An ink jet apparatus according to claim 1, wherein said pump further includes a reciprocable shaft and a seal member, said piston is mounted on said reciprocable shaft, said shaft having a first outer surface and a second outer surface of a first outer diameter and a second outer diameter, respectively, and said seal member is provided between said shaft and an inner wall portion of said cylinder, wherein said seal member closely contacts the first outer surface of the first outer diameter of said shaft when said piston is in said operating portion of said cylinder, and the second outer surface of the second outer diameter of said shaft and said seal member are in loose contact when said piston is in said standby portion of said cylinder.

9. A pump used in an ink jet apparatus having a recording head for ejecting ink onto a recording medium, said pump comprising:

a cylinder having an operating portion having an inner wall of a first inner diameter and a standby portion having an inner wall of a second inner diameter; and a piston having an outer diameter and an outer circumferential surface that is adapted to be in direct engagement with said inner wall of said operating portion, said piston being disposed within said cylinder and mounted for relative movement with said cylinder between said operating portion, wherein the outer diameter of said piston closely fits the first inner diameter of said cylinder, and said standby portion, wherein the entire outer circumferential surface of said piston loosely fits the second inner diameter of said cylinder.

10. A pump according to claim 9, wherein the second inner diameter of said inner wall of said cylinder corresponding to said standby portion is larger than the first inner diameter of said inner wall of said cylinder corresponding to said operating portion.

11. A pump according to claim 10, wherein a surface roughness of said inner wall of said cylinder corresponding to said standby portion is larger than a surface roughness of said inner wall of said cylinder corresponding to said operating portion.

12. A pump according to claim 10, wherein a recess is formed in said inner wall of said cylinder corresponding to said standby portion.

13. A pump according to any one of claims 9, 10, 11 and 12, wherein said inner wall of said cylinder corresponding to said standby portion has an ink repellent property.

14. A pump according to any one of claims 9, 10, 11 and 12, further comprising a reciprocable shaft and a seal member, wherein said piston is mounted on said reciprocable shaft having a first outer surface and a second outer surface of a first outer diameter and a second outer diameter, respectively, and said seal member is provided between said shaft and an inner wall portion of said cylinder, wherein said seal member closely contacts the first outer surface of the first outer diameter of said shaft when said piston is in said operating portion of said cylinder, and the second outer surface of the second outer diameter of said shaft and said seal member are in loose contact when said piston is in said standby portion of said cylinder.

15. An ink jet apparatus having a recording head for ejecting ink onto a recording medium, said apparatus comprising:

a pump, including a cylinder having an operating portion and a standby portion, a piston assembly disposed within said cylinder and having a shaft and a piston, said piston connected to said shaft, said shaft having a first outer surface of a first outer diameter and a second outer surface of a second outer diameter, said piston being mounted for relative movement with said cylinder between said operating portion and said standby portion, and a single seal member disposed in said cylinder and having an inner surface for sealing said shaft and an outer surface for sealing said cylinder during relative movement of said piston and said cylinder, and a port in said cylinder for communicating with said recording head; and drive means for moving said piston relative to said cylinder to generate pressure at said port while said piston is in said operating portion, wherein the inner surface of said seal member closely fits the first outer surface of said shaft when said piston occupies said operating portion of said cylinder and a whole of the inner surface of said seal member loosely fits the second outer surface of said shaft when said piston occupies said standby portion of said cylinder.

16. An ink jet apparatus according to claim 15, wherein the second outer diameter of the second outer surface of said shaft is smaller than the first outer diameter of the first outer surface of said shaft.

17. An ink jet apparatus according to claim 16, wherein a surface roughness of the second outer surface of said shaft is larger than a surface roughness of the first outer surface of said shaft.

18. An ink jet apparatus according to claim 16, wherein a recess is formed in the second outer surface of said shaft.

19. An ink jet apparatus according to any one of claims 15, 16, 17 and 18, wherein the second outer surface of said shaft has an ink repellent property.

20. An ink jet apparatus according to any one of claims 15, 16, 17 and 18, wherein said recording head has an ejection outlet and energy generation means for generating energy utilized to eject ink through said ejection outlet.

21. An ink jet apparatus according to claim 20, wherein said energy generation means comprises an electrothermal transducer capable of generating thermal energy.

22. A pump used in an ink jet apparatus having a recording head for ejecting ink onto a recording medium, said pump comprising:

a cylinder having an operating portion and a standby portion;

a piston assembly disposed within said cylinder and having a shaft and a piston, said piston connected to said shaft, said shaft having a first outer surface of a first outer diameter and a second outer surface of a second outer diameter, said piston being mounted for relative movement with said cylinder between said operating portion and said standby portion; and a single seal member disposed in said cylinder and having an inner surface for sealing said shaft and an outer surface for sealing said cylinder during relative movement of said piston and said cylinder, wherein the inner surface of said seal member closely fits the first outer surface of said shaft when said piston occupies said operating portion of said cylinder and a whole of the inner surface of said seal member loosely fits the second outer surface of said shaft when said piston occupies said standby portion of said cylinder.

23. A pump according to claim 22, wherein the second outer diameter of the second outer surface of said shaft is smaller than the first outer diameter of the first outer surface of said shaft.

24. A pump according to claim 23, wherein a surface roughness of the second outer surface of said shaft is larger than a surface roughness of the first outer surface of said shaft.

25. A pump according to claim 23, wherein a recess is formed in the second outer surface of said shaft.

26. A pump according to any one of claims 22, 23, 24 and 25, wherein the second outer surface of said shaft has an ink repellent property.

* * * * *

UNITED STATES PATENT AND TRADEMARK OFFICE

CERTIFICATE OF CORRECTION

PATENT NO. : 5,724,080

DATED : March 3, 1998

INVENTOR(S) : MASAHARU IKADO

It is certified that error appears in the above-identified patent and that said Letters Patent is hereby corrected as shown below:

COLUMN 1

Line 44, "a phenomenon that" should read --the--.

COLUMN 2

Line 26, "released" should read --released by--.

COLUMN 3

Line 58, "the IC" should read --IC--.

COLUMN 5

Line 24, "255. The" should read --255. ¶ The--.

COLUMN 6

Line 22, "was" should read --is--; and
Line 26, "invention" should read --invention,--.

COLUMN 7

Line 20, "104a" should read --104d--;
Line 22, "do" should read --does--; and
Line 50, "plunger." should read --plunger 104.--.

UNITED STATES PATENT AND TRADEMARK OFFICE

CERTIFICATE OF CORRECTION

PATENT NO. : 5,724,080

DATED : March 3, 1998

INVENTOR(S) : MASAHARU IKADO

It is certified that error appears in the above-identified patent and that said Letters Patent is hereby corrected as shown below:

COLUMN 8

Line 1, "free from pump that is" should read --that is free from pump--.

Signed and Sealed this

Eighth Day of September, 1998

Bruce Lehman

*Attest:*

BRUCE LEHMAN

*Attesting Officer*

*Commissioner of Patents and Trademarks*